US005571439A

United States Patent [19]

Daley et al.

[11] Patent Number: 5,571,439

[45] Date of Patent: Nov. 5, 1996

[54] MAGNETRON VARIABLE POWER SUPPLY WITH MODING PREVENTION

[75] Inventors: Chuck Daley, Olean, N.Y.; Robert J. Sweetman, Olney, Md.; Charlie Lenny, Orlando, Fla.

[73] Assignee: Fusion Systems Corporation, Rockville, Md.

[21] Appl. No.: 429,843

[22] Filed: Apr. 27, 1995

[51] Int. Cl.[6] ..... H05B 6/68

[52] U.S. Cl. ..... 219/716; 219/717; 219/761; 331/91; 315/106; 315/107; 363/21

[58] Field of Search ..... 219/715, 716, 219/717, 718, 702, 761; 331/91; 315/101, 105, 106, 107, 307; 363/21, 28, 96

[56] References Cited

U.S. PATENT DOCUMENTS

| | | | |
|---|---|---|---|
| 3,611,027 | 10/1971 | Koinuma et al. | 315/307 |
| 3,780,252 | 12/1973 | Crapuchettes | 219/10.55 |
| 3,780,253 | 12/1973 | Senn | 219/58 |
| 3,784,281 | 1/1974 | Foerstner et al. | 315/307 |
| 4,504,767 | 3/1985 | Levie et al. | 315/101 |
| 4,620,078 | 10/1986 | Smith | 219/10.55 |
| 4,825,028 | 4/1989 | Smith | 219/10.55 |
| 4,873,408 | 10/1989 | Smith et al. | 219/10.55 |
| 5,003,141 | 3/1991 | Braunisch et al. | 219/10.55 |
| 5,171,949 | 12/1992 | Fujishima et al. | 219/716 |
| 5,274,208 | 12/1993 | Noda | 219/716 |
| 5,286,938 | 2/1994 | Takei et al. | 219/715 |
| 5,300,744 | 4/1994 | Maehara et al. | 219/715 |

FOREIGN PATENT DOCUMENTS

| | | | |
|---|---|---|---|
| 1-77895 | 3/1989 | Japan | 219/716 |

*Primary Examiner*—Philip H. Leung
*Attorney, Agent, or Firm*—Pollock, Vande Sande & Priddy

[57] ABSTRACT

A power supply for a magnetron varies a power output level and prevents moding of the magnetron. To provide a variable power output, a microprocessor senses an anode current and voltage of the magnetron. Based on the sensed signals, the microprocessor adjusts the conduction angle of a thyristor to obtain the desired power level. The microprocessor also monitors the anode voltage for detecting moding of the magnetron. If moding is detected, the microprocessor adjusts the conduction angle of another thyristor to change the current supplied to the filament. By changing the filament current, the microprocessor effectively prevents the moding of the magnetron.

17 Claims, 9 Drawing Sheets

MAGNETRON VARIABLE POWER SUPPLY WITH MODING PREVENTION

FIELD OF THE INVENTION

The invention relates to power supplies, and in particular to a power supply for a magnetron which generates microwave radiation for use in heating applications.

BACKGROUND OF THE INVENTION

Power supplies for microwave applications are generally known in the art. As shown in FIG. 1A, the ferroresonant power supply circuit includes a power step-up transformer having a primary winding connected to a standard 120-volt AC, 60 Hz power source. The secondary circuit is connected to a voltage doubler. The voltage doubler includes a capacitor having a first terminal connected to the secondary winding of the transformer, and a second terminal connected to a rectifying diode. The output of the voltage doubler is supplied to the magnetron connected in series with the second diode.

While the above design for microwave applications is simple and cost-efficient, it is vulnerable to a high level anode current generated when the magnetron starts conducting. At the start of conduction, the magnetron presents a dynamic short circuit due to the instantaneous rate of change of voltage. Consequently, the ferroresonant power supply of FIG. 1A saturates, sharply reducing its output power level. After this initial period of conduction and settling of the anode current, the ferroresonant power supply returns to its normal output power level.

In addition to the undesirable drop in the output power level resulting from the high level anode current, the magnetron and the components of the power supply can be easily damaged by the current exceeding their specifications. The problem is particularly pronounced in UV curing operations where the power to the magnetron is rapidly turned on and off at a line frequency of approximately 8 to 10 milliseconds in order to improve the curing process.

One suggested solution to eliminate the high level anode current involves the insertion of a multiple-turns inductive coil into the circuit of the secondary winding, as shown in FIG. 1B. The coil is connected in series with the secondary winding of the transformer. As well known in the art, an inductive coil is equivalent to a virtual open circuit in high frequency AC circuits. According to the electro-magnetic properties of the coil, a voltage across the inductor is equal to the time rate of change of the magnetic flux generated by that inductor. As the rate of change of current increases, the voltage is developed across the terminals of the inductor with a polarity opposing the current through that inductor. The more rapidly the current changes, the greater is the voltage that appears across its terminals. Consequently, the nearly instantaneously occurring anode current would not flow through the electronic components of the circuits because the coil generates a voltage drop almost equivalent in magnitude to the secondary winding voltage, and a polarity which is reverse to the voltage polarity across the secondary winding. This solution, however, requires a very costly and bulky inductor. Many applications prohibit implementation of such inductor in the power supply circuit where cost efficiency and compactness are at a premium.

Another solution for reducing the component-damaging current proposes a phase control circuit in the primary circuit of the transformer, as described in U.S. Pat. No. 3,780,252 to Crapuchettes. The phase control circuit determines the phase angle of the AC voltage, supplied to the transformer from the power lines, during which the AC voltage is at a minimum level. The level of the anode current is therefore minimized as much as possible. In Crapuchettes, the phase angle of the AC voltage is selected so that the generated current does not exceed the rated specifications of the electronic components in the circuit. The control circuit monitors the phase of the AC voltage to control switching of the power source, thereby controlling the current. The disadvantages of this approach include increased complexity of the circuit and a number of additional components demanding a higher cost for the product.

In addition to suppressing the high level anode current, the power supply must provide a variable output power to the magnetron. Advances in the UV curing applications have shown that improved product quality can be obtained with the ability to continuously vary the power output. Variable power allows for much finer control and also provides the ability to compensate for any output degradation over time.

In the prior art, a phase angle control cannot be used to vary the output power in the ferroresonant circuit of FIG. 1A. The phase angle control causes the transformer in the ferroresonant circuit to saturate and produce high level currents which damage the components.

One of the solutions to the need for variable power delivery to the magnetron is duty cycling, as described in U.S. Pat. No. 4,620,078 to Smith. In Smith, a particular power level is selected by switching on or off the high voltage transformer for a number of line cycles using a triac. According to Smith, on/off cycles can range from 1 second to 30 seconds in the microwave oven industry.

The duty cycle with the microwave powered lamp, on the other hand, can be no more than ½ 60-Hz line cycle: 8 to 10 milliseconds. If the off time is longer than 8–10 milliseconds, the bulb plasma, contained in the lamp, would extinguish. Restarting the bulb plasma then becomes extremely difficult until sufficient additive has condensed. This operation can take 10 seconds or more and is clearly impractical in the UV applications. A need therefore exists for a variable power supply in all heating applications, including UV.

Yet another desired characteristic of power supplies for magnetrons is prevention of moding. The filament is a source of electrons in the magnetron. If heated the filament produces electrons generating RF emissions. Moding of the magnetron occurs when its filament temporarily becomes depleted of electrons and stops conducting current through the magnetron. After accumulating enough electrons, the filament starts conducting again. This results in a faulty condition of the magnetron conducting current in bursts.

As the magnetron ages, the filament becomes depleted and can no longer support the electron flow required to maintain the desired power. When this condition occurs, the voltage of the magnetron jumps to a higher level to maintain the same power. When the filament accumulates enough electrons to support the required current, the voltage returns to a normal operating level. These oscillations between normal voltage/normal current and high voltage/low current damage the power supply components and cause the magnetron to operate outside its normal operating condition. When the frequency of oscillations increases, the magnetron and the power supply components can no longer perform according to the desired specifications and must be replaced.

A need, therefore, exists for preventing the moding of the magnetron and extending its operating life.

OBJECTS OF THE INVENTION

It is therefore an object of the invention to provide a power supply for suppressing a high level anode current during the switching of a magnetron.

It is another object of the invention to provide a power supply for preventing moding of a magnetron.

It is yet another object of the invention to provide a power supply which has a variable power output.

SUMMARY OF THE INVENTION

These and other objects, features and advantages are accomplished by a power supply for a magnetron.

The disclosed power supply provides a high voltage and a filament voltage to a magnetron used in a heating process. The high voltage portion of the power supply is thyristor-controlled for producing a controllable direct current for the magnetron, which is related to a conduction angle of the thyristor.

In accordance with the invention, a detecting means detects an anode current and an anode voltage of the magnetron. A microprocessor is programmed to process the detected anode current and the anode voltage of the magnetron and derive a conduction angle setting for the thyristor.

To change a power level, an operator sets the power to a desired level. In response to the power request for the desired level, the microprocessor calculates a target current for the anode of the magnetron and compares the target current with the actual anode current. The difference between the actual anode current and the target anode current is used by the microprocessor to control the conduction angle of the thyristor to generate the target anode current.

Further according to the invention, a filament current is generated under control of a second thyristor which is related to its conduction angle. The microprocessor monitors the magnetron high voltage to detect moding of the magnetron. When moding is detected, the microprocessor adjusts the conduction angle of the second thyristor to change the filament current. The new filament current reduces the frequency of peak high voltage transitions, thereby preventing the moding of the magnetron.

DESCRIPTION OF THE PREFERRED EMBODIMENTS

Figure 1A:
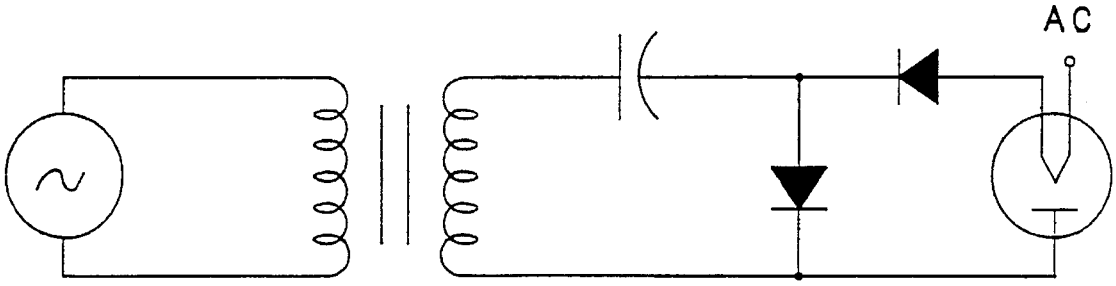
FIG. 1A PRIOR ART
FIG. 1A is a circuit diagram for the prior art ferroresonant power supply, which includes a voltage doubler.
Figure 1B:
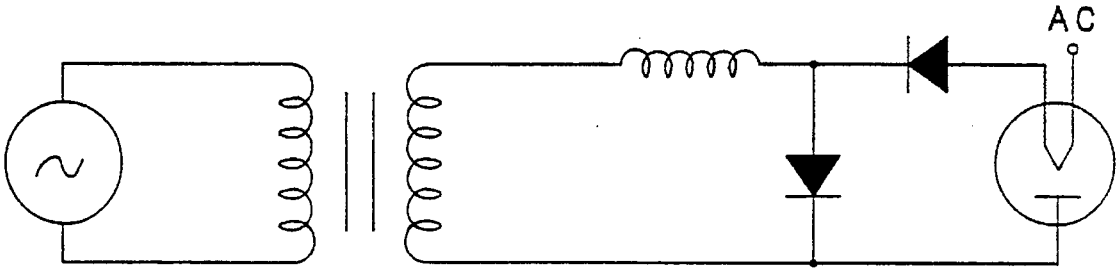
FIG. 1B PRIOR ART
FIG. 1B is a circuit diagram for the prior art power supply which uses an inductor to suppress high a level anode current.
Figure 2:
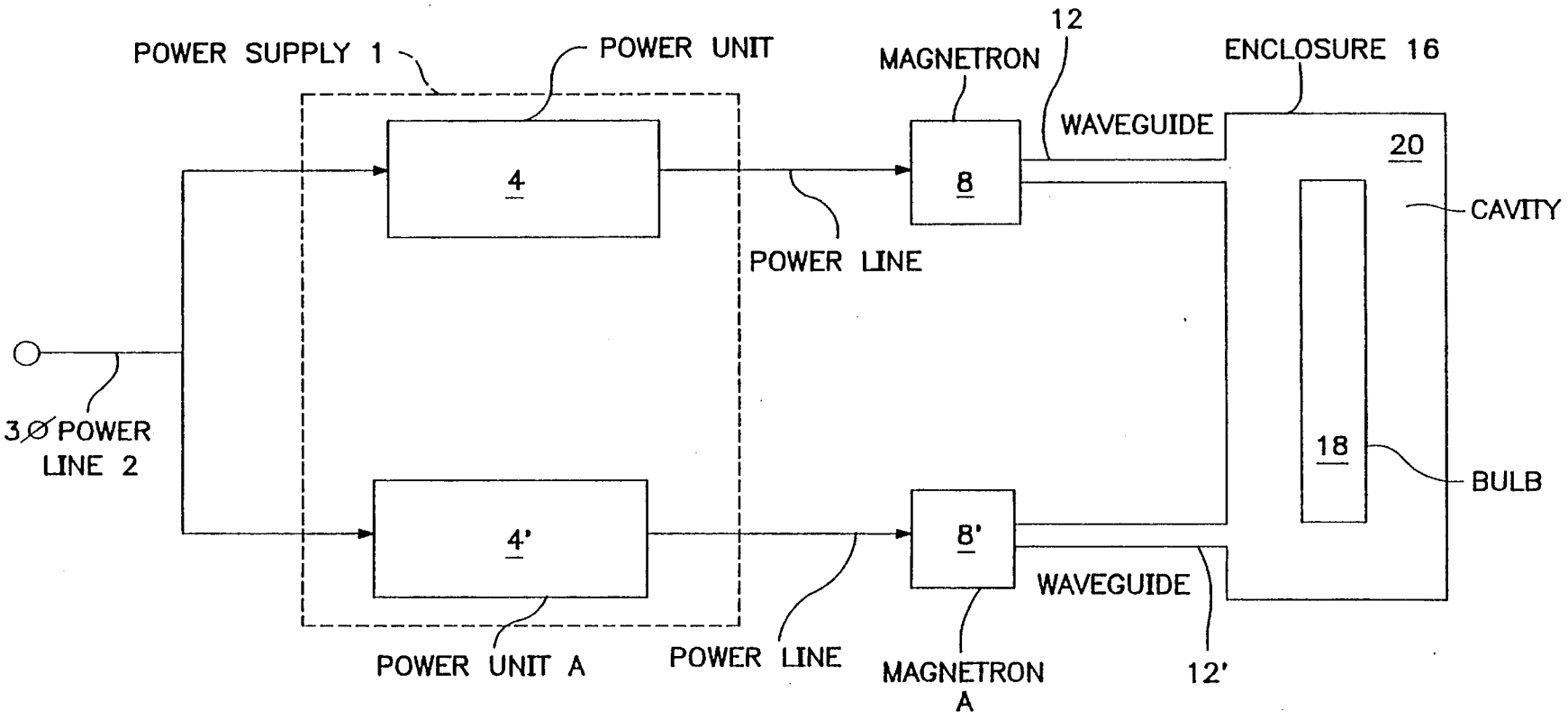
FIG. 2 is a block diagram of a power supply comprising two identical power units, each providing power to a magnetron for generating microwave radiation in an ultraviolet heating application.

FIG. 2 is a block diagram of a power supply 1 for a magnetron. The power supply 1 comprises two identical power units, a power unit 4 and a power unit A 4'. A three-phase power line 2 supplies an AC voltage to the power supply 1 and the two power units 4 and 4'. Each power unit 4 and 4' provides power for two magnetrons 8 and 8' which generate microwave radiation for a heating application. The microwave radiation is coupled to an ultraviolet lamp 18 via two wave-guides 12 and 12' which are connected to the cavity 20 of the enclosure 16 in which the ultraviolet lamp 18 is located. The ultraviolet lamp 18 is used in heating or curing applications.

In reference to all figures, elements in two power units 4 and 4' are identical and designated with the same reference numerals, with the exception that the numerals for the power unit A 4' are suffixed by a symbol "prime". Therefore, the description will be directed only to the power unit 4 with the understanding that it equally applies to the power unit A 4'. Specific instances where the power units 4 and 4' differ from each other will be noted in the text.

Figure 3:
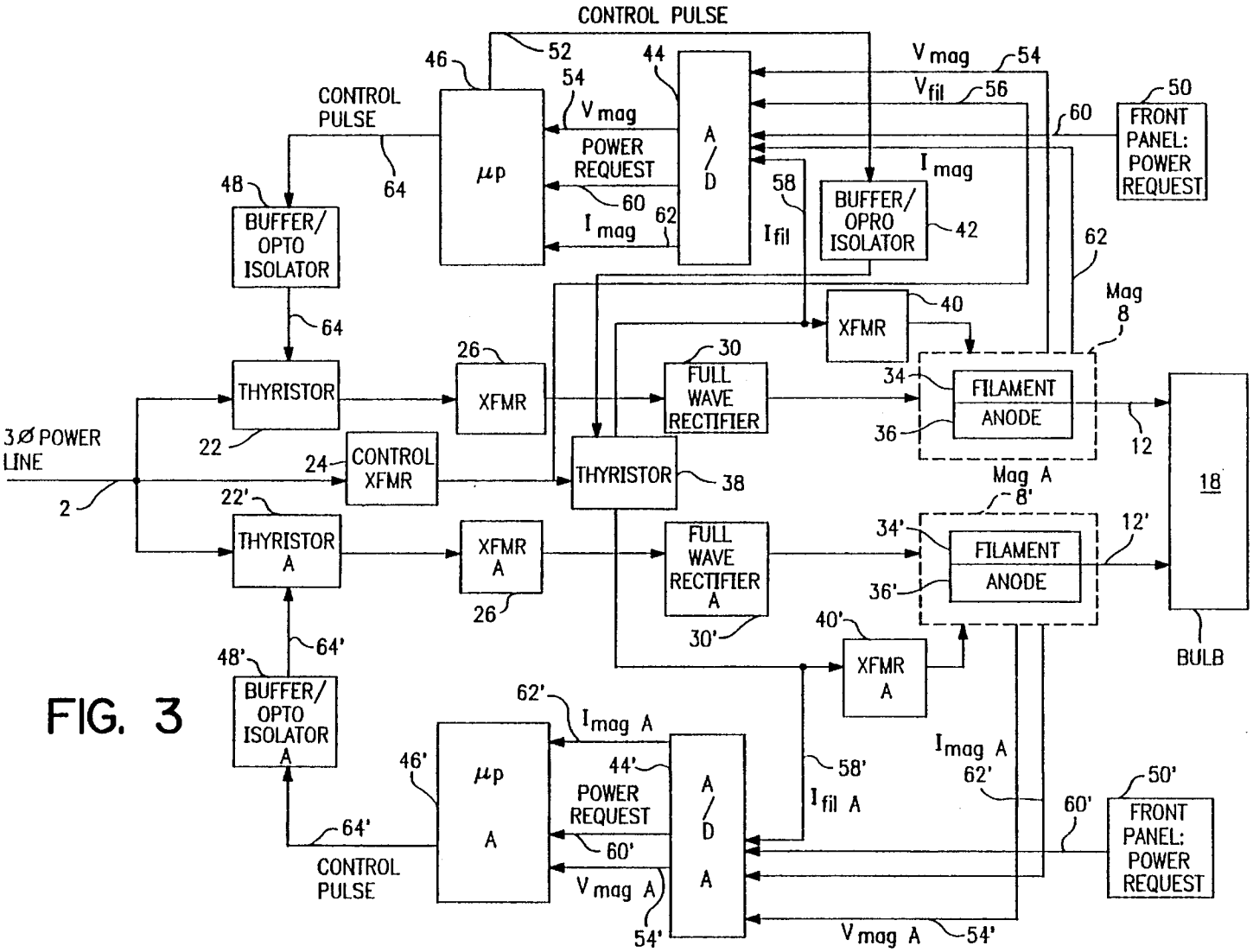
FIG. 3 is a detailed block diagram of a power supply for a magnetron in a heating application for a UV lamp.

Referring to FIG. 3, the power supply 1 includes a DC high voltage source and an AC filament voltage source.

The DC high voltage source comprises a step-up transformer 26, a thyristor 22, and a full wave bridge rectifier 30. The three-phase power line 2 supplies AC voltage to the thyristor 22 which is connected in series to the high voltage step-up transformer 26. The high voltage step-up transformer 26 is connected to the full wave rectifier 30 for providing a DC voltage to the magnetron 8, which is related to a conduction angle of the thyristor 22. The DC voltage from the full wave rectifier 30 is applied to an anode 36 of the magnetron 8.

The AC filament voltage source for the magnetron 8 includes a control transformer 24, a step-down transformer 40 and a second thyristor 38. The AC voltage from the three-phase power line 2 is supplied to the filament 34 via the control transformer 24, the thyristor 38 and the step-down transformer 40. The AC voltage produced by the step-down transformer 40 is related to a conduction angle of the thyristor 38. The control transformer 24 and the thyristor 38 are shared by both power units 4 and 4', as shown in FIG. 3.

An analog-to-digital converter 44 senses and converts the sensed anode voltage $V_{MAG}$ 54, the sensed anode current $I_{MAG}$ 62, the sensed filament voltage $V_{FIL}$ 56, and the sensed filament current $I_{FIL}$ 58 to digital signals. In addition, a power request 60 from the front panel 50 and a line frequency 96 are applied to the analog-to-digital converter 44. Alternatively, the power request 60 and the line frequency 96 may already be in a digital representation, eliminating the conversion by the analog-to-digital converter 44. The signals are then processed by a microprocessor 46. The microprocessor 46 controls the conduction angle of the thyristors 22 and 38 via control pulses 64 and 52 respectively, through buffer/optoisolators 48 and 42.

Figure 4:
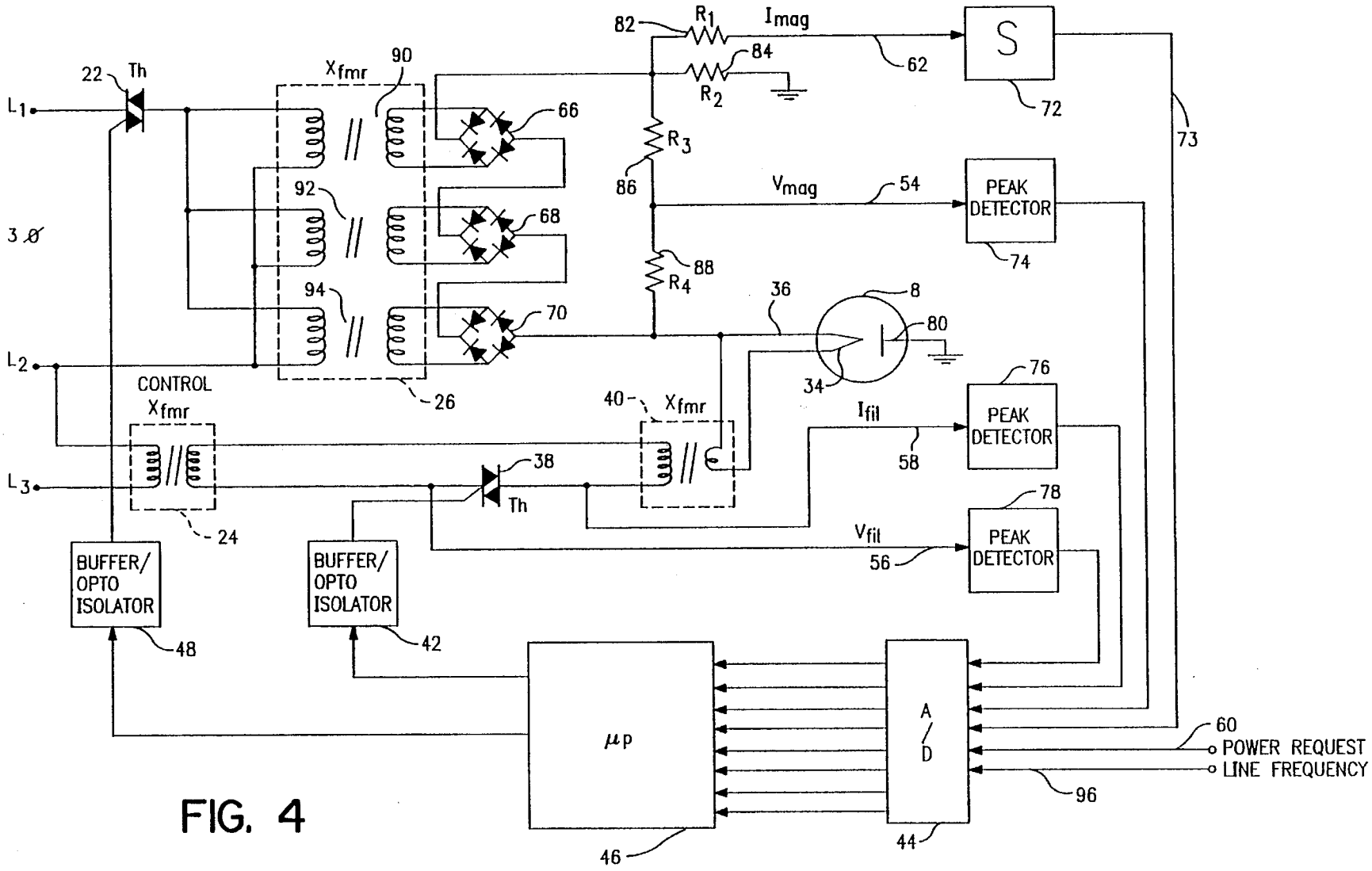
FIG. 4 is a circuit diagram for a portion of a power supply comprising means for varying a power level and preventing moding of the magnetron.

A more detailed description of the DC high voltage source of the power supply 1 is shown in FIG. 4. The thyristor 22 controls the phase angle of the AC voltage from lines 1 and 2 of the three-phase power line 2. The operation of the thyristor 22 is well known in the art and will not be described in detail. The thyristor 22 is connected in series with the step-up transformer 26. The step-up transformer 26 is comprised of three transformers 90, 92 and 94. As is also well known in the art, the primary windings of the transformers 90, 92 and 94 are electromagnetically coupled to the secondary windings to produce a high voltage on the secondary side of the transformers 90, 92 and 94 due to a larger number of turns of coil on the secondary side than the primary side.

The primary windings of the individual transformers 90, 92 and 94 are connected in parallel with each other and controlled by the thyristor 22. The secondary windings of the transformers 90, 92 and 94 are rectified via bridge rectifiers 66, 68 and 70 comprising a plurality of diodes. The outputs from the bridge rectifiers 66, 68 and 70 are connected in series with each other to produce a DC high voltage. One end of the DC output is connected to ground potential via a resistor 84, while the other end of the DC output is connected to an anode 36 of the magnetron 8.

FIG. 4 also shows the AC filament voltage source of the power supply 1 in more detail. The control transformer 24 provides a nominal 240 VAC from lines L2 and L3 of the three-phase power supply. The primary winding of the step-down transformer 40 is connected to the control transformer 24 via the thyristor 38. The secondary winding of the step-down transformer 40 is connected to the filament 34 of the magnetron 8. The filament 34 generates electrons when heated by the current produced from the step-down transformer 40. When the filament 34 is heated and high voltage is applied to the anode, the electrons produced by the magnetron 8 generate microwave energy for conduction to the ultraviolet lamp 18.

The detecting means of the power supply 1 will be described next. The sensed anode current $I_{MAG}$ 62, which flows through a resistor 82, is integrated by an integrator 72 to obtain an average anode current 73. The sensed anode voltage $V_{MAG}$ 54 is monitored by providing a voltage divider comprising resistors 86 and 88 across the full wave bridge rectifiers 66, 68, and 70. The sensed anode voltage $V_{MAG}$ 54 passes through the peak detector 74 for determining the peak anode voltage. The sensed current $I_{FIL}$ 58 is detected by a peak detector 76, sensed in the primary winding of the transformer 40. Similarly, the sensed voltage $V_{FIL}$ 56 is detected by a peak detector 78, sensed in the secondary winding of the control transformer 24. The signals from the integrator 72 and the peak detectors 74, 76, and 78 are converted to the digital signals by the analog-to-digital converter 44 for subsequent processing by the microprocessor 46.

After the microprocessor 46 processes the digitized signals from the analog-to-digital converter 44, it inputs those signals into the buffer/optoisolators 48 and 42 for controlling the thyristors 22 and 38. Various resistors limit the current to the peak detectors 74, 76, and 78, as well as the integrator 72, in conformance with a general engineering design.

Next, continuing with the description of FIG. 4, the operation of the power supply 1 will be explained when the power is varied in response to an operator request. The microprocessor 46 controls the current and voltage in the primary windings of the step-up transformer 26 by sensing the magnetron current 62 and adjusting the conduction angle of the thyristor 22 in the primary windings in response to the sensed current. The adjustment is based on the feedback from the current in the secondary windings of the transformer 26. Thus, the microprocessor 46 monitors the current in the secondary windings and adjusts this current by controlling the current and voltage in the primary windings of the step-up transformer 26.

As well known in the art, the magnetron has a cutoff voltage. The magnetron can be modeled as a zener diode in series with a resistor. Therefore, the magnetron does not conduct any current until the voltage reaches a particular threshold level. After the threshold voltage is reached, it is characteristic of the magnetron to keep it constant at the cutoff level. Any increase in current will not increase the voltage of the magnetron 8. Therefore, in order to control the power of the magnetron 8 supplied to the lamp 18, current to the magnetron must be varied since the magnetron 8 has a substantially constant voltage. Controlling the current in the primary side of the step-up transformer 26 provides for a variable power output of the magnetron 8.

Figure 5:
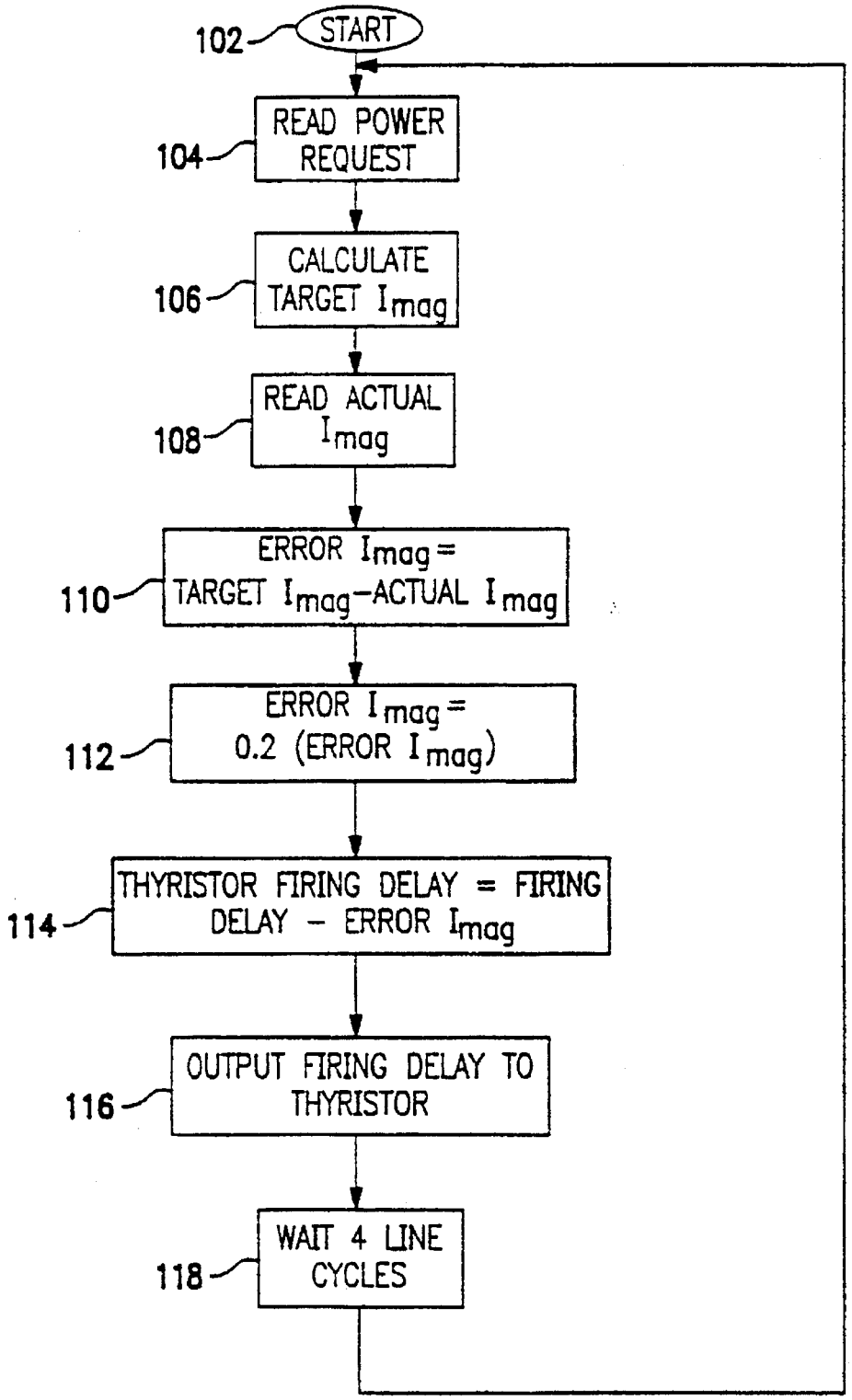
FIG. 5 illustrates programming steps for varying a power level in a power supply.

FIG. 5 illustrates programming steps involved in varying a power level in the power supply 1. After the start 102, the microprocessor 46 reads the power request 60 from the front panel 50. The step of reading the power request 60 is indicated as 104 in FIG. 5. In step 106, the microprocessor 46 calculates the target anode current of the magnetron 8 in order to adjust the power to a desired level. The target anode current equals the anode current at the 100% output power level of the magnetron 8 multiplied by the power request 60 which is in the range of 25%–100%. In step 108, the microprocessor 46 obtains a reading of the actual anode current. Next, as shown in step 110, an error anode current is calculated from the difference between the target anode current and the actual anode current 73. In step 112, a percentage of the error current is calculated in order not to increase the current by a large amount and possibly damage the components, if increase in the power level is requested. The error current is, therefore, changed in small increments. In step 114, the microprocessor 46 calculates the firing delay of the thyristor 22, based on the error current, in order to achieve the target current. The firing delay is then output to the thyristor 22, as shown in step 116, for increasing or decreasing the conduction angle based on the desired power level. Step 118 shows a waiting period of four line cycles until the next power request 60 is read from the front panel 50.

Figure 6:
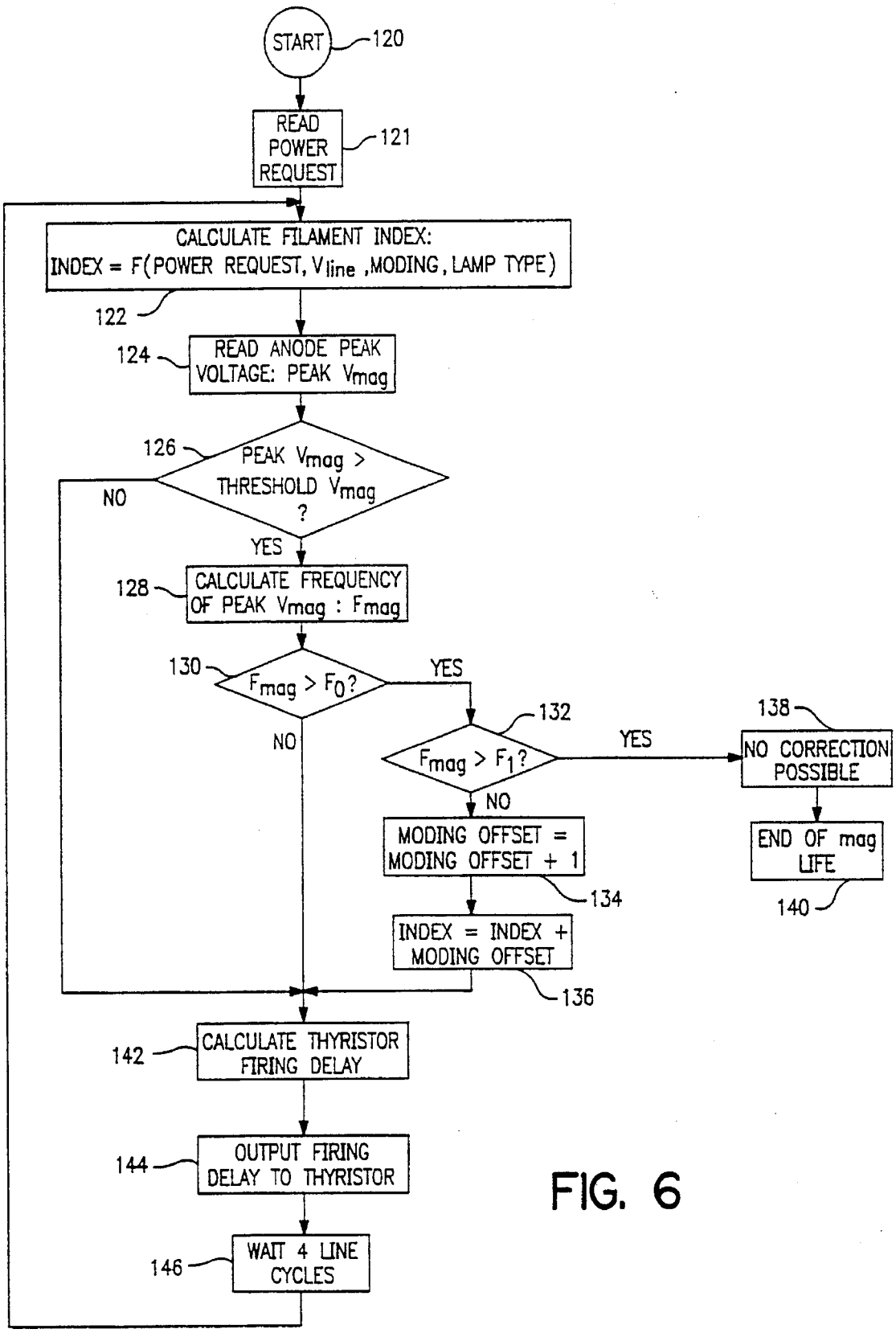
FIG. 6 illustrates programming steps for preventing moding of the magnetron in a power supply.

The operation of the power supply 1 in preventing moding of the magnetron will be described next, as shown in FIG. 6. After the start as indicated in step 120, the microprocessor 46 reads the power request 60 in step 121 and calculates a filament index in step 122. The filament index is a function of the type of the magnetron 8, the line frequency 96, and whether moding is occurring. The line frequency 96 may be stored in the microprocessor 46 or external memory, or, in the alternative, sensed and digitized via the analog-to-digital converter 44. The filament index is calculated as follows:.

$$\text{Filament index} = \frac{V_{standby}\left(100 - \frac{K^* \text{ Power request}}{100}\right)}{V_{FIL\,56}}$$

where:

K=constant based on the type of the magnetron 8;

Power request=1 to 100;

$V_{standby}$=filament voltage in standby condition based on the type of the magnetron 8.

After calculating the filament index in step 122, the microprocessor 46 reads the anode peak voltage, obtained via the peak detector 74 in step 124. In step 126, the peak anode voltage is compared with a threshold voltage stored in the microprocessor 46 or an external memory. If the peak anode voltage exceeds the threshold voltage, step 128 is performed. If, however, the peak anode voltage is less than the threshold voltage, step 142 is performed, which omits any adjustments to the firing delay of the thyristor 38.

In step 128, the microprocessor 46 determines the frequency of those peak anode voltages which exceed the threshold voltage. Next in 130, the frequency of the excursions above the threshold voltage is compared. A predetermined frequency $F_0$ of excursions above the threshold voltage is typically considered normal in the operation of the magnetron 8. If the frequency of excursions above the threshold voltage exceeds the predetermined frequency $F_0$, the frequency of transitions above the threshold voltage is compared to another frequency $F_1$ in step 132. If the frequency of voltage transitions exceeds the frequency $F_1$, no correction is possible, as indicated in step 138, which signifies the end of the magnetron life as indicated in step 140. If, however, the frequency of transitions above the threshold level is less than $F_1$, the moding offset is incremented as indicated in step 134.

Next, in 136, the filament index is updated with the moding offset, and in step 142, the firing delay of the thyristor 38 is adjusted based on the filament index. Based on the line frequency 96, the firing delay of the thyristor 38 is inversely related to the filament index. The firing delay of the thyristor 38 decreases as the filament index increases, meaning that the thyristor 38 conducts more often if the filament index is increased. Thus, as the frequency of the voltage excursions above the threshold voltage increases, the conduction angle of the thyristor 38 increases to pass more filament current 58, thereby increasing the temperature of the filament 34 of the magnetron 8. In step 144, the firing delay to the thyristor 38 is generated by the microprocessor 46 thereby controlling the conduction angle of the thyristor 38. After waiting for 4 line cycles as indicated in step 146, the microprocessor 46 restarts its operation of calculating the filament index in order to determine a proper firing delay and conduction angle for the thyristor 38. By adjusting the firing delay of the thyristor 38, the microprocessor 46 effectively prevents the moding of the magnetron 8. As the magnetron ages, more filament current is typically needed to prevent moding. Hence, an increase of the filament index will correspond to the lengthening of the on-time of the thyristor 38. The magnetron 8 can, therefore, continue functioning according to the desired specifications, and its life is therefore extended.

Figure 7A:
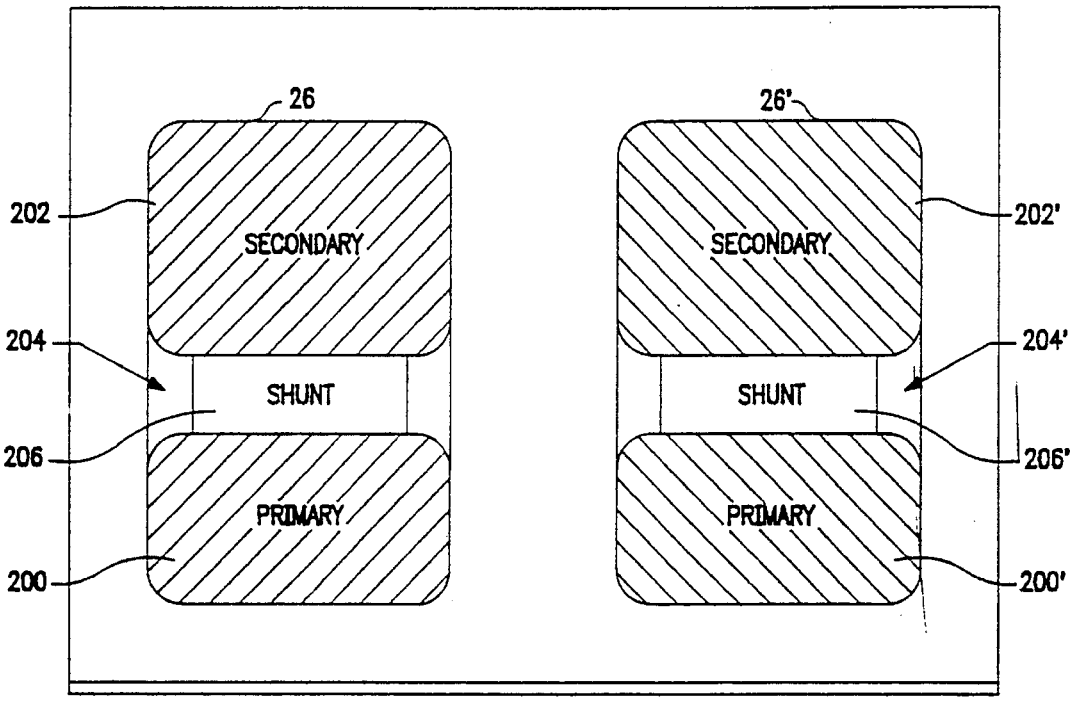
FIG. 7A is an illustration of a step-up transformer 26 for suppressing a high level anode current.

Next, the operation of the step-up transformer 26 which suppresses the high level anode current will be described in connection with FIGS. 7A, 7B, 7C, and 8. FIG. 7A is an illustration of the transformer design for suppressing the high level anode current. As indicated earlier, the reference numerals and the "prime" reference numerals designate identical elements of the two power units 4 and 4'. Referring again to FIG. 7A, the step-up transformer 26 includes a primary winding 200 electromagnetically coupled to the secondary winding 202 through an iron core. Located in the iron core of the step-up transformer 26 is a magnetic shunt 206 in series with an air gap 204.

Figure 7B:
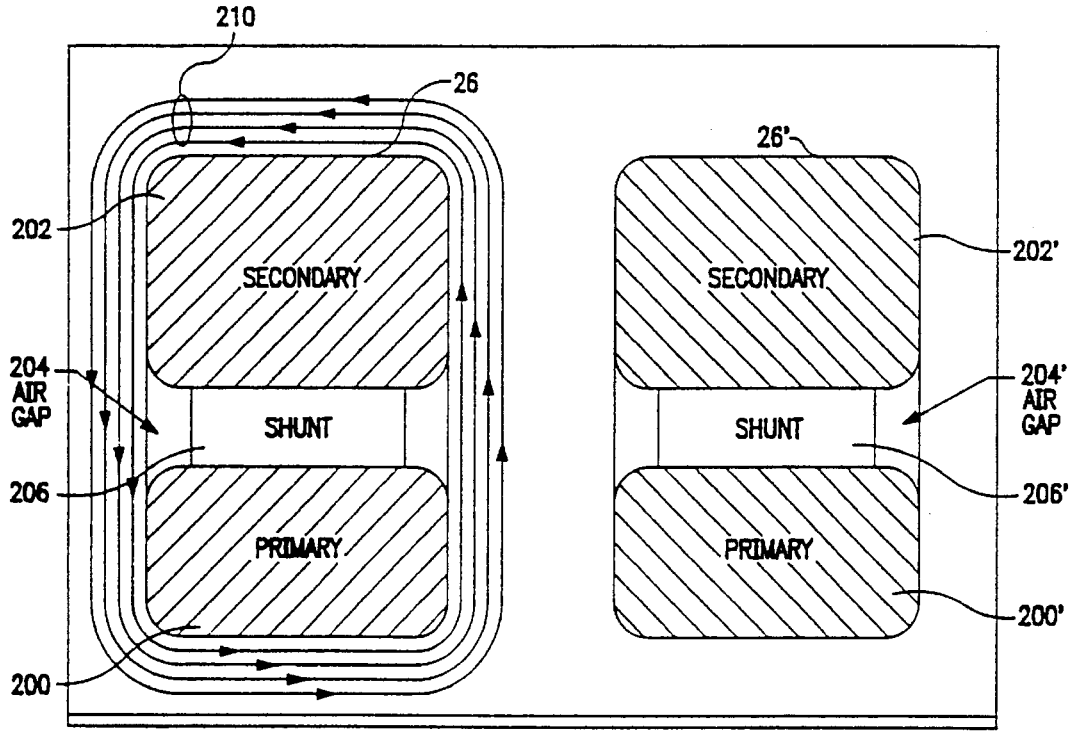
FIG. 7B shows a flux path in the step-up transformer 26 during the no-load operation of the power supply.

As shown in FIG. 7B, magnetic flux 210 is driven through the iron core by the primary winding 200. During the no-load operation of the step-up transformer 26, the air gap 204 blocks the flux 210 due to its low magnetic permeability. Consequently, all flux flows through the iron core, and around the air gap 204 and the magnetic shunt 206.

Figure 7C:
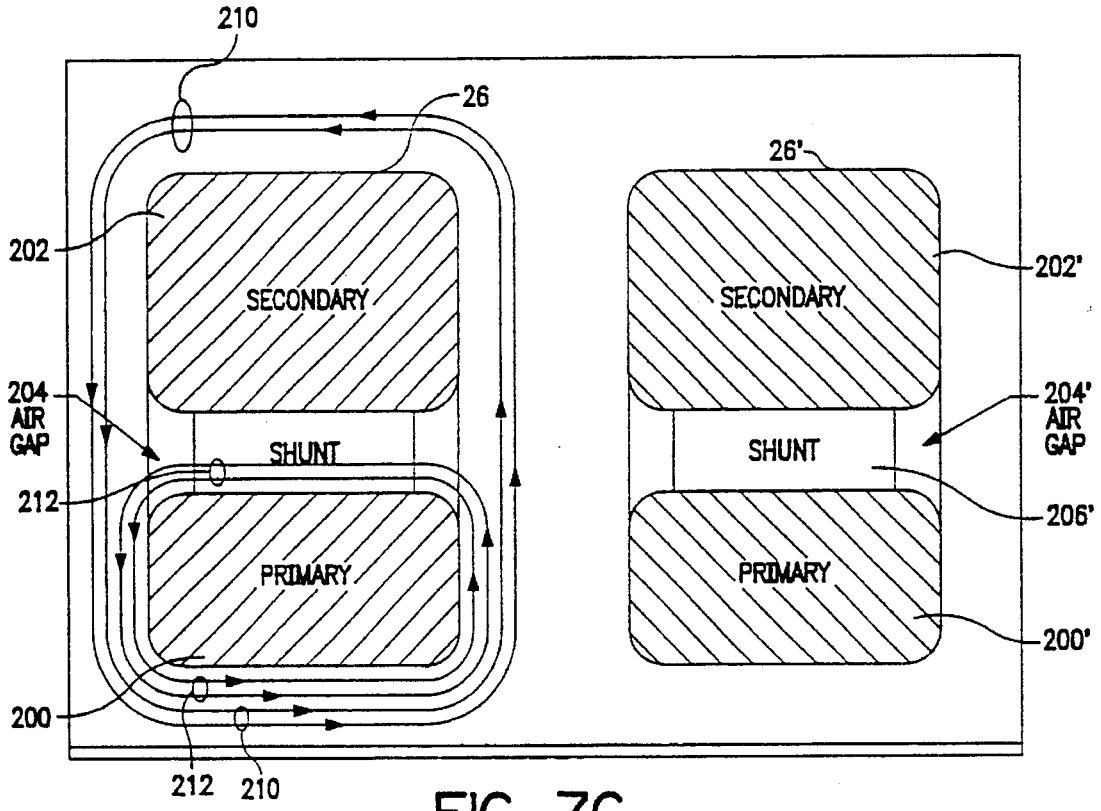
FIG. 7C shows flux paths in the step-up transformer 26 under load.

When the magnetron 8 starts conducting, it effectively represents a dynamic short circuit. The secondary winding 202 becomes heavily loaded generating a large numerical quantity of magnetic flux. Some of the flux 210 overcomes the magnetic permeability of the air gap 204 and becomes diverted to the magnetic shunt 206. This results in the flux 212 passing through the magnetic shunt 206, as shown in FIG. 7C. As a result of the bypassing flux, some of the current, corresponding to this bypassing flux, becomes diverted from the secondary winding 202 of the step-up transformer 26 entailing a reduction in the high level anode current.

Figure 8:
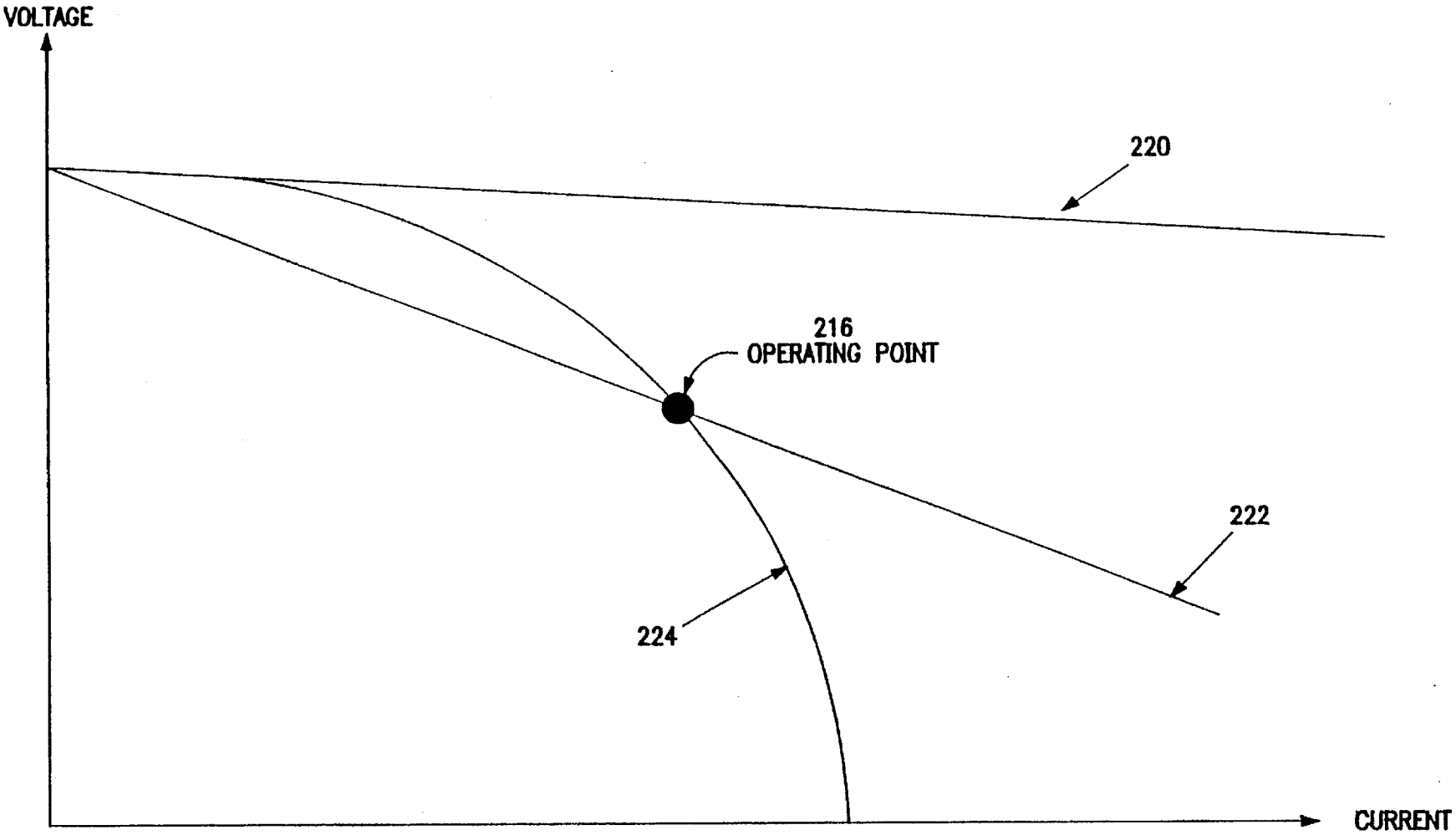
FIG. 8 illustrates load lines for conventional transformers and the step-up transformer 26 disclosed herein.

FIG. 8 shows a load line for the transformer 26 of the disclosed power supply, as well as load lines for other transformers used in power supplies. A conventional transformer relies on coil resistance to limit its current. The coil resistance, however, is insufficient to limit the high level anode current. As shown in FIG. 8, the load line 220 does not intersect the operating point 216, when the magnetron 8 starts conducting. The load line 220 therefore illustrates the inapplicability of the conventional transformer to power supplies for the magnetron.

The load line of a linear transformer is also shown in FIG. 8 and designated 222. The linear transformer has additional windings to provide resistance in limiting the high level current. The equivalent circuit for this transformer consists of a resistor connected in series with the conventional transformer described in the preceding paragraph. As shown in FIG. 8, the load line 222 passes through the operating point 216. Although the linear transformer prevents the high level anode current from damaging the components and the magnetron 8, its bulkiness and the prohibitive power dissipation severely limits its effective use in the power supplies with magnetrons.

In addition, the short circuit current for the conventional and linear transformers is very high, as estimated by the projected intersection of the load lines 220 and 222 with the I-axis. In the step-up transformer 26 employing the magnetic shunt 206, the short circuit current is much smaller than in the other two transformers, as shown from the curved load line 224 which intersects the I-axis at a significantly lower numerical value. The curvature of the load line 224 of the step-up transformer 26 is due to the magnetic shunt 206 which also limits the high level anode current without the power loss of high resistance associated with the linear transformer. Thus, during the start of conduction when the magnetron 8 acts as a dynamic short circuit, the high level anode current is effectively controlled by the step-up transformer 26.

Since those skilled in the art can modify the disclosed specific embodiment without departing from the spirit of the invention, it is, therefore, intended that the claims be interpreted to cover such modifications and equivalents.

What is claimed is:

1. A power supply for supplying operating voltages to a magnetron used in a heating process, comprising:

a DC high voltage source controlled by a first thyristor for producing a direct current for said magnetron which is related to a conduction angle of said first thyristor;

a source of AC filament voltage for said magnetron controlled by a second thyristor for producing a filament current related to a conduction angle of said second thyristor;

a first means for detecting an anode current and an anode voltage of said magnetron;

a second means for detecting a filament current and a filament voltage of said magnetron; and a microprocessor means connected to said first and second means, which is programmed to:

determine from a desired power setting, a target current for said anode current, control said conduction angle of said first thyristor for generating high voltage which produces said target current, monitor said anode voltage of said magnetron for determining moding of said magnetron; and control said conduction angle of said second thyristor for producing a filament current which eliminates said moding of said magnetron.

2. The power supply according to claim 1, wherein said step of programming said microprocessor means to determine said target current comprises (a) determining an error current which is a difference between said actual anode current and said target current, and (b) changing said actual anode current in discrete increments, wherein each discrete increment is a portion of said error current.

3. The power supply according to claim 1, wherein said microprocessor means is programmed to determine moding by comparing said peak anode voltage with a threshold voltage, and calculating a frequency of transitions of said peak anode voltage above said threshold voltage.

4. A power supply for supplying operating voltages to a magnetron having an anode and a filament, wherein said magnetron is used in a heating process, said power supply comprising:

a pair of power units in parallel with each other, connected to a plurality of power lines which provide an AC operating voltage, wherein each power unit supplies direct current to said anode and alternating current to said filament, and includes (a) a power control circuitry for varying said direct current in response to a desired power setting, and (b) a filament control circuitry for increasing said alternating current in response to moding of said magnetron.

5. The power supply according to claim 4, wherein said power control circuitry comprises:

a DC high voltage source including a step-up transformer connected to said AC operating voltage through a first thyristor and connected to a rectifying means for producing direct current for said magnetron which is related to a conduction angle of said first thyristor; and a feedback circuit connected between said anode of said magnetron and said first thyristor, including:

(a) a first means for detecting an average anode current and a peak anode voltage of said magnetron; and (b) a microprocessor means connected to said first means through an analog-to-digital converter means, for controlling said direct current by (1) determining a target anode current from said desired power setting, said average anode current and said peak anode voltage, and (2) varying a conduction angle of said first thyristor to generate a high voltage which produces said target anode current.

6. The power supply according to claim 5 further comprising a converter means connected between said first means and said microprocessor means, for converting said average anode current and said peak anode voltage of said magnetron to digital signals.

7. The power supply according to claim 4, wherein said filament control circuitry comprises:

a source of AC filament voltage for said magnetron including a step-down transformer connected to said AC operating voltage through a second thyristor, which produces a filament current related to a conduction angle of said second thyristor; and a feedforward circuit connected between said filament of said magnetron and said second thyristor, including:

(a) a second means for detecting a peak filament current of said magnetron; and (b) a microprocessor means connected to said second means through an analog-to-digital converter means, for reducing moding of said magnetron by (1) determining a frequency of transitions of a peak anode voltage above a threshold voltage, and (2) increasing said peak filament current until said frequency of transitions decreases below said threshold voltage.

8. The power supply according to claim 7 further comprising a converter means connected between said second means and said microprocessor means, for converting said peak filament current and said peak filament voltage of said magnetron to a digital signal.

9. A power supply for supplying operating voltages to a magnetron used in a heating process, comprising:

a first thyristor connected to a three-phase AC voltage source for providing a conduction angle to an AC operating voltage;

a step-up transformer unit connected to said first thyristor, for providing an increased AC voltage from said AC operating voltage;

a rectifying means coupled to said step-up transformer unit, for converting said increased AC voltage to a DC voltage;

a magnetron coupled to said rectifying means for generating microwave radiation;

a lamp electromagnetically coupled to said magnetron via a waveguide, for receiving said microwave radiation for use in said heating process;

a second thyristor connected to said three-phase AC voltage source via a control transformer;

a step-down transformer connected between said second thyristor and said filament, for providing a filament current to heat said filament under control of said second thyristor;

a microprocessor connected between said first and second thyristors, and said magnetron through a digital-to-analog converter means, for controlling said first and second thyristors; and a first buffer means connected between said microprocessor and said first thyristor, and a second buffer means connected between said microprocessor and said second thyristor, for processing signals of said microprocessor, whereby a desired power setting is obtained by controlling said first thyristor and moding of said magnetron is suppressed by controlling said second thyristor.

10. The power supply according to claim 9, wherein said rectifying means comprises a plurality of full-wave bridge rectifiers, each full-wave bridge rectifier connected in series with the remaining full-wave bridge rectifiers, and having a plurality of diodes for converting an AC voltage to a DC voltage.

11. The power supply according to claim 9, wherein said transformer unit comprises a plurality of individual transformers, each transformer having a primary winding connected in parallel with primary windings of the remaining transformers and a secondary winding magnetically coupled with said primary winding.

12. The power supply according to claim 9, wherein said conduction angle of said first thyristor is controlled by alternately switching said first thyristor for providing said AC operating voltage to said transformer unit in relation to said desired power setting.

13. A power supply for supplying a filament current to a magnetron, comprising:

a source of AC filament voltage for said magnetron including a step-down transformer connected to said AC operating voltage through a thyristor for producing a filament current related to a conduction angle of said thyristor; and a feedforward circuit connected between said filament of said magnetron and said thyristor, including:

(a) a means for detecting a peak filament current of said magnetron; and (b) a microprocessor means connected to said means through an analog-to-digital converter means, for detecting moding of said magnetron and controlling said thyristor to reduce said moding.

14. The power supply according to claim 13, wherein said microprocessor means determines said moding from a frequency of transitions of a peak anode voltage of said magnetron above a threshold voltage.

15. The power supply according to claim 13 further comprising a converter means connected between said means and said microprocessor means, for converting said peak filament current of said magnetron to a digital signal.

16. A method for providing a variable power by a power supply to a magnetron used in a heating process, comprising:

generating direct current for an anode of said magnetron, which includes connecting a step-up transformer to an AC operating voltage via a thyristor and rectifying a stepped-up AC voltage for said magnetron;

detecting an anode current and an anode voltage of said magnetron;

determining from a desired power setting a target current for said anode current; and controlling alternating current on a primary side of said step-up transformer by adjusting a conduction angle of said thyristor via a microprocessor means, thereby establishing a voltage corresponding to said desired power setting which produces said target current.

17. A method for preventing moding of a magnetron in a power supply for said magnetron used in a heating process, comprising:

generating a filament voltage, which includes connecting a step-down transformer to an AC operating voltage via a thyristor;

detecting a peak anode voltage of said magnetron;

determining a frequency of transitions of said peak anode voltage above a threshold voltage by monitoring and comparing said peak anode voltage with said threshold voltage; and reducing said frequency of transitions of said peak anode voltage above a threshold voltage by controlling a conduction angle of said thyristor.

* * * * *